US009117583B2

(12) United States Patent
Bory et al.

(10) Patent No.: US 9,117,583 B2
(45) Date of Patent: Aug. 25, 2015

(54) ELECTROMAGNETIC ACTUATOR DEVICE

(75) Inventors: Raphael Bory, Eching (DE); Jonas Boll, Hamburg (DE); Daniela Haerter, Munich (DE); Robert Steyer, Munich (DE); Philipp Terhorst, Icking (DE); Thomas Schiepp, Seitingen-Oberflacht (DE); Markus Laufenberg, Radolfzell (DE); Oliver Thode, Bodman-Ludwigshafen (DE); Viktor Raff, Radolfzell (DE)

(73) Assignee: ETO Magnetic GmbH, Stockach (DE)

( * ) Notice: Subject to any disclaimer, the term of this patent is extended or adjusted under 35 U.S.C. 154(b) by 0 days.

(21) Appl. No.: 14/005,299

(22) PCT Filed: Mar. 15, 2012

(86) PCT No.: PCT/EP2012/054547

§ 371 (c)(1),
(2), (4) Date: Jan. 13, 2014

(87) PCT Pub. No.: WO2012/123538

PCT Pub. Date: Sep. 20, 2012

(65) Prior Publication Data

US 2014/0125437 A1 May 8, 2014

(30) Foreign Application Priority Data

Mar. 16, 2011 (DE) ..... 20 2011 004 021 U

(51) Int. Cl.

| | |
|---|---|
| ***H01F 7/00*** | (2006.01) |
| ***H01F 7/16*** | (2006.01) |
| ***H01F 7/08*** | (2006.01) |

(52) U.S. Cl.

CPC ..... *H01F 7/1638* (2013.01); *H01F 7/081* (2013.01)

(58) Field of Classification Search

CPC ..... H01H 51/2227; H01H 51/2209; H01H 2051/2218; H02K 7/1085; H02K 7/116; H01F 7/122; H01F 7/1615; H01F 7/08; H01F 7/14; H01F 7/1646

USPC ..... 335/267

See application file for complete search history.

(56) References Cited

U.S. PATENT DOCUMENTS 4,127,835 A * 11/1978 Knutson ..... 335/266
4,157,520 A * 6/1979 Moates et al. ..... 335/230

(Continued)

FOREIGN PATENT DOCUMENTS

| | | |
|---|---|---|
| DE | 197 12 669 | 10/1998 |
| DE | 100 33 923 | 1/2002 |
| DE | 101 46 899 | 10/2003 |

OTHER PUBLICATIONS

International Search report dated Jun. 5, 2012.

*Primary Examiner* — Shawki S Ismail
*Assistant Examiner* — Lisa Homza
(74) *Attorney, Agent, or Firm* — Bachman & LaPointe, PC

(57) ABSTRACT

An electromagnetic actuator device, comprising a coil unit (14), which surrounds a first yoke section (13) of a stationary yoke unit and can be activated by energizing the coil unit; and armature elements (10, 12), which are guided so as to be movable relative to the yoke unit and which interact with an output-side actuating partner and which can be driven in order to perform an actuating movement. The armature elements interact with at least one second yoke section (15, 16) of the yoke unit to form an air gap (26, 28) for a magnetic flux produced by the activated coil unit.

10 Claims, 1 Drawing Sheet

(56) References Cited

U.S. PATENT DOCUMENTS

| | | | | | |
|---|---|---|---|---|---|
| 4,164,721 | A | * | 8/1979 | Ishida et al. | 335/234 |
| 4,191,937 | A | * | 3/1980 | Koehler et al. | 335/230 |
| 4,217,507 | A | * | 8/1980 | Jaffe et al. | 310/12.07 |
| 4,253,493 | A | * | 3/1981 | English | 137/625.18 |
| 4,306,207 | A | * | 12/1981 | Tada et al. | 335/234 |
| 4,419,643 | A | * | 12/1983 | Ojima et al. | 335/234 |
| 4,422,060 | A | * | 12/1983 | Matsumoto et al. | 335/256 |
| 4,451,808 | A | * | 5/1984 | Koehler | 335/229 |
| 4,524,797 | A | * | 6/1985 | Lungu | 137/343 |
| 4,538,126 | A | * | 8/1985 | Bando | 335/78 |
| 4,550,302 | A | * | 10/1985 | Watanabe et al. | 335/228 |
| 4,560,966 | A | * | 12/1985 | Nagamoto et al. | 335/80 |
| 4,561,632 | A | * | 12/1985 | Hugler | 251/129.15 |
| 4,633,209 | A | | 12/1986 | Belbel et al. | |
| 4,679,017 | A | * | 7/1987 | Mishler et al. | 335/164 |
| 4,706,055 | A | * | 11/1987 | Uetsuhara | 335/229 |
| 4,716,393 | A | | 12/1987 | Logie | |
| 4,746,886 | A | * | 5/1988 | Uetsuhara | 335/230 |
| 4,751,487 | A | * | 6/1988 | Green, Jr. | 335/234 |
| 4,797,645 | A | * | 1/1989 | Uetsuhara | 335/230 |
| 4,835,503 | A | * | 5/1989 | Everett | 335/229 |
| 4,868,695 | A | * | 9/1989 | Quatro et al. | 360/256.3 |
| 4,903,578 | A | * | 2/1990 | Terp | 91/499 |
| 4,994,776 | A | * | 2/1991 | Juncu | 335/234 |
| 5,032,812 | A | * | 7/1991 | Banick et al. | 335/17 |
| 5,257,014 | A | * | 10/1993 | Zimmermann | 340/686.1 |
| 5,268,662 | A | * | 12/1993 | Uetsuhara et al. | 335/229 |
| 5,303,012 | A | * | 4/1994 | Horlacher et al. | 335/253 |
| 5,388,086 | A | * | 2/1995 | Yamasaki et al. | 369/44.14 |
| 5,453,724 | A | * | 9/1995 | Seymour et al. | 335/172 |
| 5,523,684 | A | * | 6/1996 | Zimmermann | 324/207.22 |
| 5,556,175 | A | * | 9/1996 | Hayakawa et al. | 303/119.2 |
| 5,584,466 | A | * | 12/1996 | Fukano et al. | 251/65 |
| 5,809,157 | A | * | 9/1998 | Grumazescu | 381/412 |
| 5,850,170 | A | * | 12/1998 | Kern | 335/229 |
| 5,955,934 | A | * | 9/1999 | Raj | 335/277 |
| 5,969,589 | A | * | 10/1999 | Raj | 335/277 |
| 6,242,994 | B1 | * | 6/2001 | Li et al. | 335/277 |
| 6,265,956 | B1 | * | 7/2001 | Cascolan et al. | 335/234 |
| 6,293,516 | B1 | * | 9/2001 | Parsons et al. | 251/129.04 |
| 6,305,662 | B1 | * | 10/2001 | Parsons et al. | 251/129.04 |
| 6,321,781 | B1 | * | 11/2001 | Kurth | 137/554 |
| 6,450,478 | B2 | * | 9/2002 | Parsons et al. | 251/129.04 |
| 6,737,946 | B2 | * | 5/2004 | Seale et al. | 335/279 |
| 6,816,048 | B2 | * | 11/2004 | Morita et al. | 335/220 |
| 6,836,201 | B1 | * | 12/2004 | Devenyi et al. | 335/229 |
| 6,853,100 | B2 | * | 2/2005 | Yumita | 310/12.24 |
| 6,856,222 | B1 | | 2/2005 | Forck | |
| 6,940,376 | B2 | * | 9/2005 | Morita et al. | 335/220 |
| 6,948,697 | B2 | * | 9/2005 | Herbert et al. | 251/129.04 |
| 7,075,398 | B2 | * | 7/2006 | Morita et al. | 335/220 |
| 7,280,019 | B2 | * | 10/2007 | Kolb et al. | 335/229 |
| 7,352,268 | B2 | * | 4/2008 | Wright et al. | 335/229 |
| 7,605,680 | B2 | * | 10/2009 | Matsumoto et al. | 335/229 |
| 7,864,008 | B2 | * | 1/2011 | Schilling | 335/257 |
| 7,871,060 | B2 | * | 1/2011 | Armour | 251/129.15 |
| 7,965,161 | B2 | * | 6/2011 | Roche | 335/229 |
| 7,969,772 | B2 | * | 6/2011 | Gubbins et al. | 365/164 |
| 8,013,698 | B2 | * | 9/2011 | Bonjean et al. | 335/229 |
| 8,093,969 | B2 | * | 1/2012 | Liu et al. | 335/78 |
| 8,106,734 | B2 | * | 1/2012 | Gruden | 335/229 |
| 8,159,807 | B2 | * | 4/2012 | Pohl | 361/160 |
| 8,193,887 | B2 | * | 6/2012 | Sohn | 335/299 |
| 8,493,166 | B2 | * | 7/2013 | Golz et al. | 335/264 |
| 8,567,440 | B2 | * | 10/2013 | Walter | 137/625.44 |
| 8,576,032 | B2 | * | 11/2013 | Herbert et al. | 335/220 |
| 8,581,682 | B2 | * | 11/2013 | Patino et al. | 335/229 |
| 2001/0023876 | A1 | * | 9/2001 | Estelle et al. | 222/146.5 |
| 2001/0026204 | A1 | * | 10/2001 | Petro | 335/229 |
| 2003/0030524 | A1 | * | 2/2003 | Sato et al. | 335/220 |
| 2004/0113730 | A1 | * | 6/2004 | Watanabe et al. | 335/220 |
| 2008/0179553 | A1 | * | 7/2008 | Walter | 251/65 |
| 2010/0123093 | A1 | * | 5/2010 | Beyer et al. | 251/129.15 |
| 2010/0192885 | A1 | * | 8/2010 | Golz et al. | 123/90.17 |
| 2010/0289605 | A1 | * | 11/2010 | Beyer et al. | 335/229 |
| 2011/0133576 | A1 | * | 6/2011 | Golz et al. | 310/12.32 |
| 2011/0267159 | A1 | * | 11/2011 | Schiepp et al. | 335/232 |
| 2012/0031360 | A1 | * | 2/2012 | Laufenberg et al. | 123/90.17 |
| 2013/0113582 | A1 | * | 5/2013 | Schiepp et al. | 335/228 |
| 2014/0028420 | A1 | * | 1/2014 | Scanlon | 335/230 |
| 2014/0091646 | A1 | * | 4/2014 | Schiepp et al. | 310/26 |

* cited by examiner

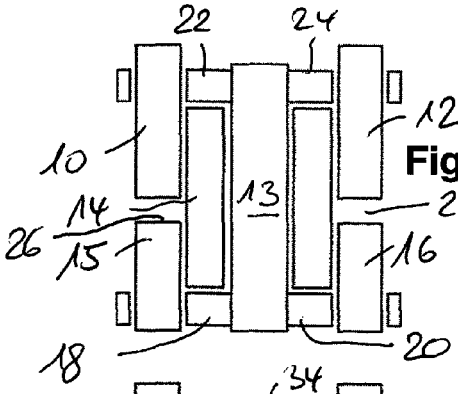
Fig. 1
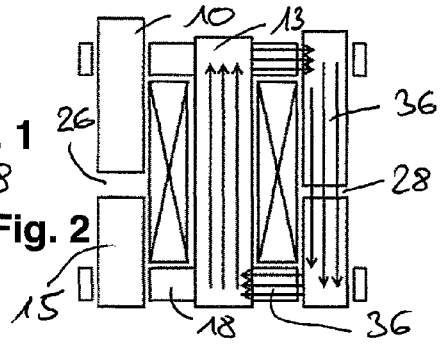
Fig. 2
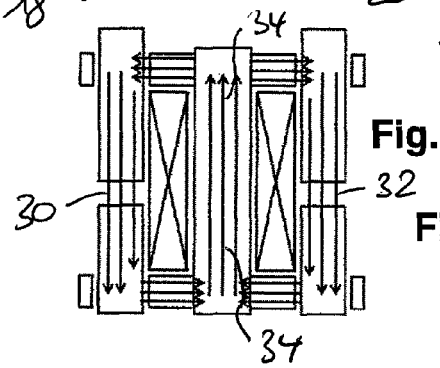
Fig. 3
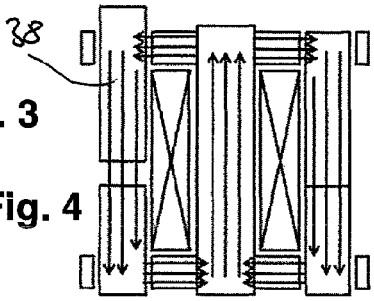
Fig. 4
Fig. 6
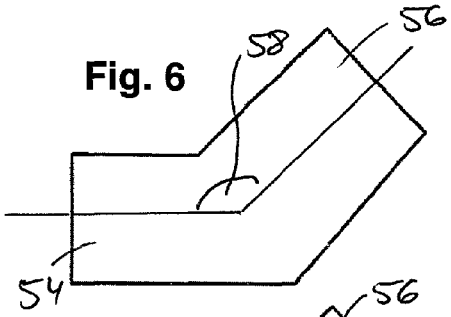
Fig. 7
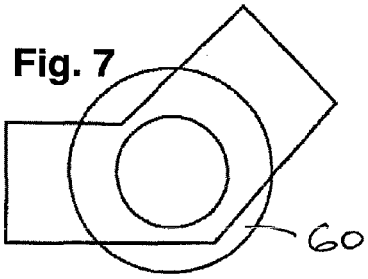
Fig. 8
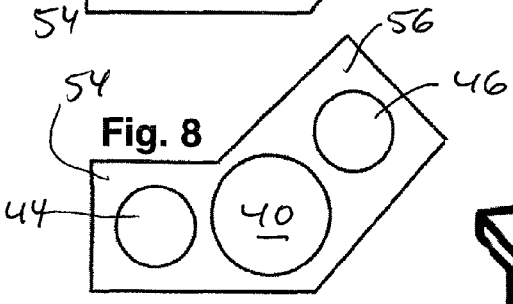
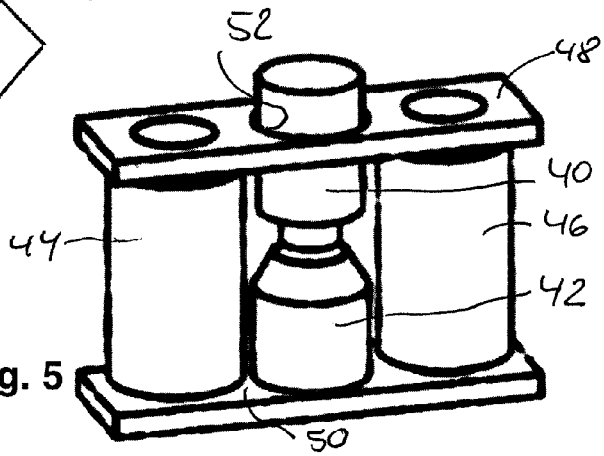
Fig. 5

ELECTROMAGNETIC ACTUATOR DEVICE

BACKGROUND OF THE INVENTION

The present invention concerns an electromagnetic actuator device.

Such a device is for example of known art from JP 2000 170951 A and concerns an electromagnetic actuator device for the implementation of a 3-way valve, in which, in a departure from conventional actuator technologies, which moreover are presupposed to be of known art, the coil winding does not surround the armature (or the related working air gap), rather the coil winding, in the form of an "outsourced" coil is laterally displaced relative to a longitudinal axis of armature movement (and a related air gap) and a magnetic flux transfer takes place to the armature unit, and to the air gap, by means of suitable flux-conducting sections of the yoke.

However the disclosure in accordance with JP 2000 170951 A is made in a very particular technical context, which in particular makes possible a transference to other generic actuation tasks (or to other valve drives) in only a very limited manner. Moreover the device of known art from this prior art also requires a not insignificant build space, wherein in addition heat removal from the device of known art is not without its problems.

SUMMARY OF THE INVENTION

The object of the present invention is therefore to create an electromagnetic actuator device in which a coil unit that can be energised surrounds a first yoke section of a stationary yoke unit, and armature means, controlled such that it can move relative to the yoke unit, interacting with an actuation partner, and which can be driven so as to execute an actuation movement, interact with a second yoke section of the yoke unit with the formation of the working air gap, with regard to improving a more compact, in particular also a more flexible mechanical implementation, thereby in particular to create the possibility of separating the coil unit from the working air gap, and to create the possibility of implementing an improved heat removal, or to allow heat to occur in a locally distributed manner (and thus less concentrated at one location).

The object is achieved by means of the electromagnetic actuator device with the features disclosed herein; advantageous developments of the invention are also described herein.

In an inventively advantageous manner provision is made on the one hand, with an armature locally separated from the coil unit (i.e. the coil unit does not surround the working air gap) to assign to the coil unit at least one, preferably a plurality of working air gaps, which interact accordingly with one or a plurality of armature units. In this respect the magnetic flux generated by the coil unit can be used for the plurality of armature units, in accordance with a flux distribution that is to be described in accordance with a development of the invention.

Thus within the context of the invention it is already possible to achieve the object also by means of a generic electromagnetic actuator device, in which just one (at least one) armature unit is provided, and which, to implement the inventive principle, is provided laterally spaced apart from, and/or adjacent to, the coil unit, i.e. spaced apart from, and/or adjacent to the first yoke section.

Equally comprised by the invention is the independently claimed solution principle, that the coil unit is implemented in the form of a plurality of individual coils, separated from one another, but nevertheless connected with one another in terms of magnetic flux, which in accordance with further preferred configurations of the invention then in accordance with the solution enable a locally distributed arrangement of individual coils in each case, (smaller to dimension and thus also potentially generating less heat) whose respective magnetic flux is then brought together in a cumulative manner for the common armature (and for the related working air gap) and in this respect is summated.

It is common to all aspects of the invention that the working air gap (i.e. the at least one air gap provided within the context of the first aspect of the invention) is/are formed outside the first yoke section, thus it is not enclosed by a coil unit (in a development of the invention typically of a cylindrical or a rectangular design), but in the sense discussed above is laterally outsourced.

In a particularly preferred configuration of the first aspect of the invention, namely of the design of an individual or a plurality of magnetic flux-conducting circuits in the yoke unit, wherein each of the flux-conducting circuits runs through the first yoke section (carrying the common coil), and also across a particular one of the air gaps assigned to one of the plurality of armature units, a magnetic flux resistance of the flux conducting agents of at least one of the magnetic flux-conducting circuits can be varied as a function of a magnetic flux that is flowing therein. This occurs in particular in that by a suitable configuration of an effective flux-conducting cross-section of these flux-conducting agents saturation occurs from a predetermined magnetic flux density, thus from this threshold the magnetic flux resistance is increased. The consequence of this effect is that a magnetic flux from the flux-conducting circuit concerned is displaced into another of the flux-conducting circuits; in this respect an armature movement can then be triggered or influenced.

Further possibilities for the pre-adjustment, or predetermined manipulation of the movement behaviour of the plurality of armature units (in the particular yoke arms) consists in the fact that the air gaps can be configured differently (in each case with reference to a predetermined, comparable armature position, for example a contact position of the armature units). Here it is in particular in accordance with a development of the invention preferable to vary the effective air gap in a particular yoke arm, i.e. corresponding to an intended movement behaviour (for example an intended sequence of an activation), to set it up differently.

A further option for influencing the switching or movement behaviour of a particular armature unit of the armature agents lies in the assignment of spring agents or similar energy stores to this armature unit and, for example, in accordance with a development of the invention, to mount, i.e. guide, one or a plurality of the armature units against a restoring force of such a spring (wherein once again in accordance with a development of the invention the particular switching or movement behaviour of the assigned armature units can then be influenced in a predetermined manner).

The electromagnetic actuator device in accordance with the second aspect of the invention, according to which a plurality of individual coils (in a potentially small build space) are arranged suitably adjacent to the second yoke section with the working air gap such that the working air gap is located between the individual coils, advantageously envisages in accordance with a development of the invention, that at least one of the individual coils, more preferably all of the individual coils, extend parallel to a direction of movement of the armature unit, such that, for example with the arrangement of the individual coils about the working air gap, here a particularly compact unit can be created, which nevertheless does not need to be symmetrical.

In particular this also enables the present invention, by means of the described variability, to optimise one (or, in the case of a plurality of individual coils, a plurality of) effective cross-sectional areas of the first yoke section, such that, for example, the coil unit provided thereupon can be optimised (with regard, for example, to the weight of copper in the windings).

By means of flux-conducting agents, suitably provided in accordance with a development of the invention in the form of suitable elements (which more preferably for example can be implemented as sheets, or a stack of sheets, which can beneficially be stamped out in the production process) it is possible to implement structures that are beneficially adapted to a particular deployment objective (i.e. a particular site of deployment and the installation conditions applying there). Thus it is for example in accordance with a development of the invention preferable to implement these flux-conducting elements as flat, i.e. plane elements, which further advantageously, for example, are provided on both sides of central axes of both the plurality of coil devices and also of the second yoke section (with the working air gap) for purposes of the flux-conducting connection of the same, such that in turn a simple arrangement that can be produced in a manner suitable for large scale production, nevertheless one that is optimised with regard to space utilisation comes into being (wherein here in particular design options also exist for undertaking thermal optimisations).

Thus it is advantageously and in particular also made possible in accordance with a development of the invention, for asymmetric arrangements of the plurality of coil units in connection with the second yoke section to be implemented, wherein, for example, for this purpose and with a configuration of the as described plane, plate-shaped flux-conducting agents, this can be an angled structure (i.e. one implemented with legs standing at an angle relative to one another, for example of between 90° and 180° in a plane of a flat face).

In the context of further preferred forms of implementation of the second aspect of the invention it is thereby also possible and preferable, for example, for the first aspect of the invention to provide manipulation of the cross-section and/or flux resistance, provided in accordance with a development of the invention, within a particular flux-conducting circuit in a suitably analogous manner, just as, for example, the armature agents can be mounted or controlled against spring agents offering a suitable restoring force.

Correspondingly in an analogous manner provision is made within the context of further preferred forms of embodiment of the first aspect of the invention for the yoke unit to be implemented in terms of suitable sheet-type elements, more preferably in terms of flux-conducting elements manufactured by stamping and suitably stacked as required, so that here, in addition to advantages in manufacture, eddy currents are also reduced.

Also it shall be deemed to be registered and disclosed from the present invention that, for example, the spatially optimised structural geometry implemented by means of the plane, i.e. flat, flux-conducting agents, (and in accordance with a development of the invention, for example, angled) by analogy can also be provided for forms of implementation, in which, for example, armature units (with a particular working air gap) are suitably provided at the ends of the flux-conducting agents, while the common coil unit is provided in a central region.

It lies further within the context of preferred developments of the invention of the invention, to provide the individual coils in the context of the invention with any desired peripheral contours, or cross-sections, so as in this respect to utilise the possibilities for optimisation of the structural design; here, in addition to cylindrical external contours, it is in particular advantageous and is claimed in accordance with a development of the invention that one or a plurality of the individual coils should have a rectangular configuration.

As a result the inventive electromagnetic actuator device is indeed preferably suitable for the implementation of hydraulic or pneumatic valve solutions, in particular in the vehicle sector, but is not limited to these application fields. On the contrary the present invention can be beneficially utilised and suitably configured for almost any application fields, in which structural or spatial flexibility can be used in conjunction with flexibly configurable magnetic flux controls, i.e. flux paths, within the particular flux-conducting circuits.

BRIEF DESCRIPTION OF THE DRAWINGS

Further advantages, features, and details of the invention ensue from the following description of preferred examples of embodiment, and also with the aid of the drawings; in the latter:

FIG. 1 shows a representation of the principles of an electromagnetic actuator device in accordance with the first aspect of the invention and a first form of embodiment of this invention, so as to illustrate the principal interactions between the various functional components;

FIGS. 2 to 4 show various operating states, magnetic flux states and switching states of the device as per FIG. 1, illustrated by means of bundles of arrows symbolising respective magnetic fluxes;

FIG. 5 shows a perspective view of a form of embodiment of the electromagnetic actuator device of the second aspect of the invention in accordance with a further example of embodiment;

FIGS. 6 to 8 show design variants of the configuration of a flux-conducting element in further examples of embodiment compared with the example of embodiment of FIG. 5.

DETAILED DESCRIPTION

FIG. 1 illustrates in a schematic longitudinal sectional view an electromagnetic actuator device for purposes of driving two armature units 10, 12 by means of a common coil unit 14 provided centrally between the latter on a yoke section 13. Stated more precisely, as can be discerned schematically with the aid of the FIG. 1 diagram, the armature units 10, 12 respectively, represented in an elongated manner, are controlled such that they can move axially (in a direction of movement and drive at right-angles in the plane of the figure), wherein the armature units 10 and 12 interact with stationary yoke sections 15, 16 respectively and, for purposes of implementing corresponding flux-conducting circuits running jointly through the coil unit 14, which are controlled via flux-conducting connecting sections 18 to 24. Accordingly effective air gaps 26 and 28 respectively are formed for the armature units 10 and 12 respectively.

FIGS. 2 to 4 illustrate various operating states in reaction to an energisation of the coil unit 14. Thus FIG. 3 shows, for example, two flux paths in the flux-conducting circuits running through the respective armatures 10 and 12 in terms of the bundles of arrows 30 and 32 respectively, wherein these magnetic fluxes flow through the yoke section 13 (the "first yoke section") assigned to the coil unit 14, as symbolised by the bundle of arrows 34. If on the other hand, as shown in FIG. 2, the effective flux resistance in the right-hand flux-conducting circuit (i.e. with reference to the armature unit 12) is reduced relative to the other flux-conducting circuit, as a result of a shortened air gap 28, the magnetic flux is concentrated in this right hand region, as shown by the bundle of arrows 36 in FIG. 2, with the effect that a drive action arises primarily on the armature unit 12 in the direction towards the static element (yoke section 16); accordingly this air gap is then closed (as represented in FIG. 4). However, as a result of this action and appropriate (cross-sectional) dimensioning in the right-hand side flux-conducting circuit (e.g. of the flux-conducting components, namely, yoke section 16, flux-conducting connecting sections 20, 24 and armature unit 12) saturation then occurs in this flux-conducting circuit, with the effect that, as a result of the thereby once again increased flux resistance some of the magnetic flux is displaced into the left-hand flux-conducting circuit, effectively for the armature unit 10. Accordingly as a result of this displaced flux 38 force is applied to the armature unit 10, which accordingly closes the air gap 26, thus the asymmetric configuration as shown (starting from FIG. 2), illustrates, for example, how different movement and switching behaviours of the armature units, here succeeding one another in time, can be promoted.

Alternatively such an action can also be implemented by means of spring agents suitably provided on the armature units (with appropriately differing spring forces), again additionally or alternatively by means of effective magnetic flux cross-sections of the flux-conducting components involved that are adjusted in a predetermined manner and then achieve saturation accordingly.

In the example of embodiment of FIGS. 1 to 4 the two armature units 10 and 12 respectively are mechanically located directly on the coil periphery or adjacent to the latter, so that an optimised bundling of field lines occurs across both armatures, and thus on both sides of the coil unit, in a manner potentially increasing coil efficiency, compare FIG. 3. A geometric/mechanical asymmetry, for example by variation of the respective armature separation distances from the central coil, here once again allows the establishment of suitably differing flux paths, and armature movements determined from the latter. Also within the context of the first aspect of the invention a form of embodiment of the invention is provided which, in a manner not shown in the figures, simply provides for an armature unit with a related second yoke section, in accordance with the invention preferably laterally spaced apart from, or adjacent to the coil unit. Even this simplest form of embodiment already implements the inventive principle of the outsourced armature, namely an armature provided within the framework of a flux circuit arm and arranged laterally and/or adjacent (together with a related air gap) so that an armature movement direction can indeed take place in accordance with a development of the invention along an axis parallel to a direction of extent of the coil unit (i.e. of the related first yoke section), but these axes no longer run coaxially.

With the aid of FIGS. 5 to 8 the second aspect of the invention is described in what follows in terms of a further example of embodiment. FIG. 5 illustrates a first variant in a perspective view: On both sides of a central arrangement having an axially movable armature 40 and a stationary yoke section 42 a pair of individual coils 44 and 46 are provided; these are respectively configured such that the armature 40 and stator or stationary yoke section 42 are framed on both sides by the individual coils 44, 46. A magnetic flux (which occurs with the energisation of the coils) of the coils 44 and 46 respectively is transferred via common elongated plate-form flux-conducting elements 48 and 50 respectively into the armature 40 and the stator 42 respectively, wherein the elements 48 and 50 respectively in addition serve to provide a mechanical connection of the overall arrangement (with an exit opening 52 for the armature unit).

With regard to flux guidance in this device two flux-conducting circuits are again designed, wherein one of the particular flux-conducting circuits runs through one of the individual coils 44 or 46 and both flux-conducting circuits then flow jointly through the armature-stator arrangement 40, 42 (in this respect the flux path is analogous to that of FIG. 3, but with the provision of a central armature-stator arrangement and two outer-lying individual coils).

The basic configuration of FIG. 5 is nevertheless neither limited to two individual coils, nor, for example, to the symmetrical arrangement shown; rather, for example by variation of the geometry of the elements 48, 50, a variation of the separation distance can occur; as illustrated in FIGS. 6 to 8, a configuration suitably angled with respect to the extended elements 48, 50 can also be featured, or more than two individual coils can be provided about one common armature-stator arrangement (or about a plurality of common armature-stator arrangements). Thus FIG. 6 describes, for example, in plan view a variation of the elements 48 and 50 in such a way that now two legs 54, 56 extend at an angle 58 relative to one another of approx. 135°, and, compare FIG. 8, at their ends are connected with the individual coils 44 and 46 in a flux-conducting manner. A comparative arrangement of the traditional type, presupposed to be of known art, in the representation of FIG. 7, illustrates the advantage in installation space i.e. in geometry, that is thereby achieved In order namely to generate magnetic flux behaviour comparable with that of the pair of individual coils 44, 46, an individual coil with a winding cross-section 60 as indicated in FIG. 7 should be present; however, in a limited installation space (adapted to the configuration of FIGS. 6, 8) this may not be possible.

A further advantage of the inventive solution with a plurality of individual coils provided adjacent to an armature-stator arrangement with an additive, i.e. overlapping, flux path, for example, of the type shown in FIG. 5 or FIGS. 6 and 8, lies in the fact that possible transverse forces (onto the armature) in comparison to a solution with just one outsourced coil are reduced (since in this respect mutual compensation takes place, compare for example the flux diagram of FIG. 3 in the analogous application to an arrangement with two outer-lying individual coils). Particularly in the case of products with long service life requirements, such as those, for example, in the valve field, such a reduction of the transverse forces has a beneficial effect on the armature in terms of wear and at the same time promotes an effective working life.

The present invention, independently of the forms of embodiment shown or further possible forms of embodiment, makes possible numerous practical advantages. Thus the arrangement of one (or a plurality of) armature unit(s) in an application as a valve clearly offers, for example, more flexible connection options in the inventive configuration adjacent to the coil unit (or a plurality of coil units), for example, compared with the known prior art, in which typically the extended armature unit is surrounded by the coil unit (typically with a cylindrical radius). Accordingly the working air gap can be configured more flexibly (and in a manner suitable for a particular application).

In addition in accordance with a development of the invention provision is advantageously made, adapted to particular installation and spatial conditions, not to provide a particular coil (or the plurality of individual coils) with cylindrical windings, but rather, for example, to provide it with rectangular or other coil cross-sections. This applies in particular in the interaction with flux-conducting elements, which are implemented in the form of sheets (typically manufactured by stamping) and more advantageously exist in suitably stacked configurations.

Thus it is also possible for the present invention to utilise the advantages of eddy current reduction (particularly at the higher frequencies) provided by flux-conducting elements in sheet form.

The invention claimed is:

1. An electromagnetic actuator device, comprising:

a stationary yoke unit comprising a first yoke section (13) and at least two second yoke sections (15, 16);

at least two armature units (10, 12) moveable relative to the at least two second yoke sections (15, 16) so as to define first and second air gaps (26, 28) between respective armature units and second yoke sections, said armature units (10, 12) also being separately moveable relative to each other; and a coil unit (14) surrounding the first yoke section (13), wherein the armature units (10, 12) and the second yoke sections (15, 16) are radially outside of the coil unit (14), wherein activation of the coil unit (14) controls movement of the armature units (10, 12) relative to the second yoke sections (15, 16);

wherein the first yoke section (13), second yoke sections (15, 16) and armature units (10, 12) define at least first and second magnetic flux-conducting circuits, wherein each of the first and second magnetic flux-conducting circuits runs through the first yoke section (13), respective second yoke sections (15, 16), respective armature units (10, 12) and respective air gaps (26, 28); and wherein alteration of an air gap of one of the first and second magnetic flux-conducting circuits causes a flux alteration in the other of the first and second magnetic flux-conducting circuits.

2. The device in accordance with claim 1, wherein the yoke unit further comprises flux-conducting connecting sections in the first and second magnetic-flux conducting circuits, wherein magnetic flux resistance of the flux-conducting connecting sections can be varied by formation of a predetermined maximum effective flux cross-section.

3. The device in accordance with claim 2, wherein the flux-conducting connecting sections are designed such that their magnetic flux resistance can rise above a threshold value determined by the flux cross section.

4. The device in accordance with claim 2, wherein the flux-conducting connecting sections are, implemented from a magnetically conducting material and form a number of yoke arms corresponding to a number of armature units, and wherein the yoke arms are positioned on the first yoke section.

5. The device in accordance with claim 4, wherein a respective yoke arm, with an associated armature unit, forms an air gap influenced by a setting position of the armature unit.

6. The device in accordance with claim 1, wherein the air gaps define a stop position of the armature units on respective second yoke sections and have dimensions that differ from one another.

7. The device in accordance with claim 6, wherein the air gaps have an air gap spacing of variable effectiveness.

8. The device in accordance with claim 1, further comprising spring agents, wherein at least one of the armature units is mounted or controlled against a restoring force of the spring agents.

9. The device in accordance with claim 8, wherein the restoring force acting on the armature units is set up differently for at least two of the armature units.

10. The device in accordance with claim 1, wherein at least one of the first yoke section, the second yoke sections, and a flux-conducting section between the first yoke section and the second yoke sections, is implemented as at least one of a stackable sheet element and a layered arrangement of a plurality of sheet elements.

* * * * *